US005832674A

United States Patent [19]

Ledbetter et al.

[11] Patent Number: 5,832,674

[45] Date of Patent: Nov. 10, 1998

[54] SOUND ABSORPTION ROOFTOP CURB

[75] Inventors: Larry Ledbetter, Fort Smith, Ark.; Jeffery A. Meighan, Tyler, Tex.

[73] Assignee: American Standard Inc., Piscataway, N.J.

[21] Appl. No.: 555,665

[22] Filed: Nov. 13, 1995

[51] Int. Cl.[6] ..... E04D 13/14; F25D 23/12

[52] U.S. Cl. ..... 52/58; 52/27; 52/144; 52/794.1; 62/259.1; 62/DIG. 16; 181/224; 181/284

[58] Field of Search ..... 52/58, 27, 794.1, 52/794.2, 144; 62/259.1, 296, DIG. 16; 454/233, 236; 181/290, 293, 224, 284; 312/100, 257.1

[56] References Cited

U.S. PATENT DOCUMENTS

| | | | |
|---|---|---|---|
| 3,085,647 | 4/1963 | Jenn et al. | 181/56 |
| 3,110,357 | 11/1963 | Jenn et al. | 181/36 |
| 3,540,116 | 11/1970 | Daahos et al. | 52/794.1 X |
| 3,702,211 | 11/1972 | Young et al. | 312/257 |
| 3,878,655 | 4/1975 | Toth et al. | 52/27 |
| 4,016,729 | 4/1977 | Cherry | 62/259 |
| 4,315,415 | 2/1982 | Wilson | 62/263 |
| 4,403,481 | 9/1983 | Yoho, Sr. | 62/259 |
| 4,413,450 | 11/1983 | Brower | 52/27 |
| 4,501,193 | 2/1985 | Trigourea | 98/33 |
| 4,775,001 | 10/1988 | Ward et al. | 454/233 X |
| 4,917,345 | 4/1990 | Czech | 248/678 |
| 4,991,406 | 2/1991 | Fujii et al. | 62/259.1 X |
| 5,001,883 | 3/1991 | Landheer | 52/794.1 |
| 5,090,713 | 2/1992 | Johnson | 52/169.7 X |
| 5,094,054 | 3/1992 | Arends | 52/302.1 X |
| 5,148,647 | 9/1992 | Rutledge | 52/302.1 |

FOREIGN PATENT DOCUMENTS

| | | | |
|---|---|---|---|
| 683114 | 1/1994 | St. Helena | 52/794.1 |

OTHER PUBLICATIONS

Installer's Guide, Roof Mounting Curb, Curb–in–30, Aug. 1992, American Standard Inc.

*Primary Examiner*—Carl D. Friedman
*Assistant Examiner*—Winnie S. Yip
*Attorney, Agent, or Firm*—William J. Beres; William O'Driscoll; Peter D. Ferguson

[57] ABSTRACT

A curb for a rooftop air conditioning unit. The curb comprises: a frame having side walls and end walls arranged in a generally rectangular shape, and a generally planar portion overlaying a portion of the frame. The planar portion includes a first layer providing structural support, a second layer providing a sound barrier, and a third layer provides a heat energy barrier.

26 Claims, 5 Drawing Sheets

FIG. 1
(PRIOR ART)
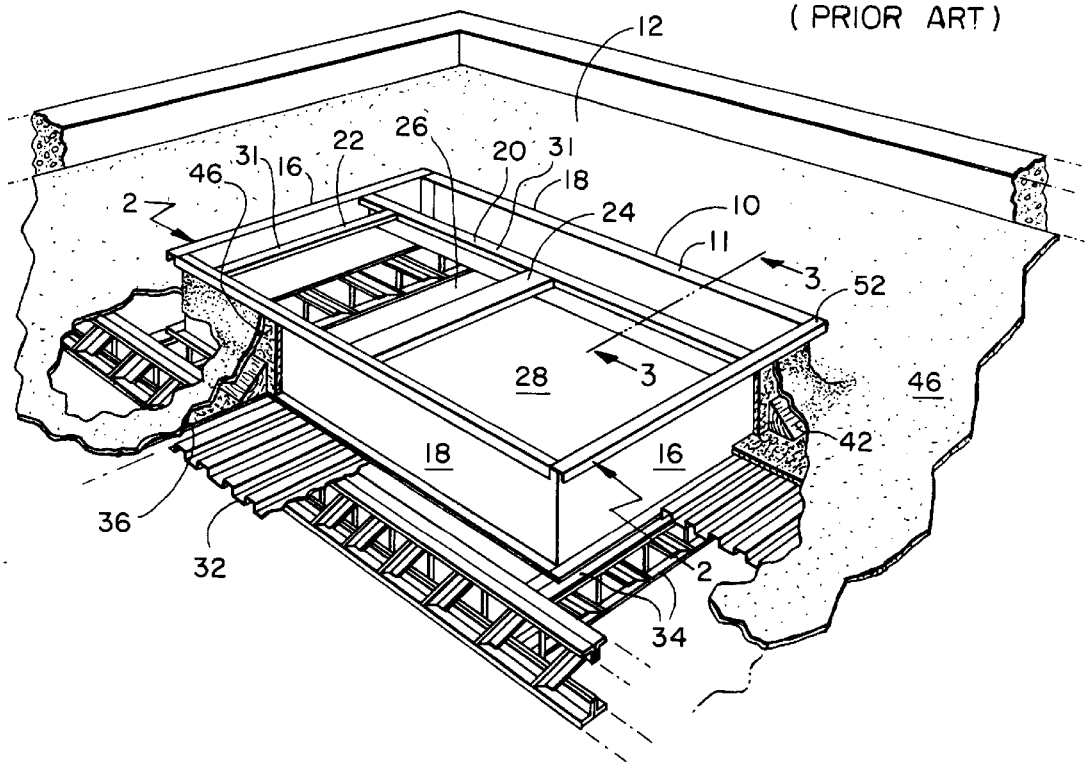
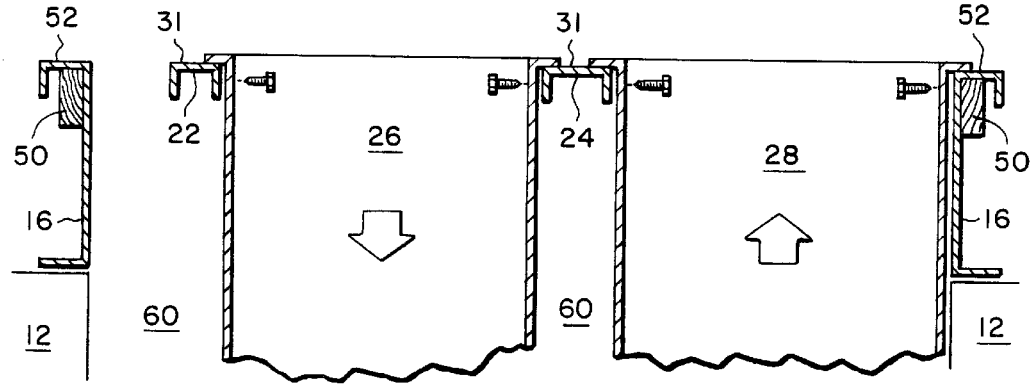
FIG. 2
(PRIOR ART)

SOUND ABSORPTION ROOFTOP CURB

BACKGROUND OF THE INVENTION

The present invention is directed to rooftop curbs for air conditioning units. In particular, the present invention is directed to providing sound and energy barriers between an air conditioning unit resting on a rooftop curb and the interior of a building supporting the rooftop curb itself.

Air conditioning units can be very noisy in their operation particularly the mechanical compression portions of an air conditioning unit. Rooftop curbs are provided to support an air conditioning unit on the surface of a building and usually are positioned above and around an aperture in the roof of a building. The sound and heat energy generated by the operation of the air conditioning unit can enter the buildings interior through the aperture and annoy the occupants while adding additional heat energy to the buildings cooling load.

SUMMARY OF THE INVENTION

It is an object, feature and advantage of the present invention to reduce or eliminate sound and/or heat energy entering a building through the aperture within a rooftop curb.

It is an object, feature and advantage of the present invention to provide a sound and heat energy barrier which can easily and economically be retrofit to existing rooftop curbs.

The present invention provides a curb for a rooftop air conditioning unit. The curb comprises: a frame having side walls and end walls arranged in a generally rectangular shape; and a generally planar portion overlaying a portion of the frame. The planar portion includes a first layer providing structural support, a second layer providing a sound barrier, and a third layer provides a heat energy barrier.

The present invention also provides a deck pan for a rooftop curb. The deck pan comprises: a generally planar pan, a box wall attached and surrounding the pan, and a flange attached to and about the box wall. the generally planar pan has a structural support layer, a sound barrier layer affixed to the structural support layer and a heat energy barrier layer affixed to the sound barrier layer.

The present invention further provides a rooftop curb comprising a deck; and a frame supporting the deck, a supply air aperture in the deck, and a return air aperture in the deck. The frame includes side walls and end walls. The deck has three layers: a structural support layer, a sound barrier layer and a heat energy barrier layer.

BRIEF DESCRIPTION OF THE DRAWING

FIG. 1 shows a perspective partial cutaway of a prior art roof mounting curb atop a building.

FIG. 2 is a cutaway of the prior art curb of FIG. 1 along lines 2—2.

FIG. 7 shows a cutaway of a representative deck pan from FIG. 4 including the tri-layered barriers of the invention.

Detailed Description of the Drawings

Figure 3:
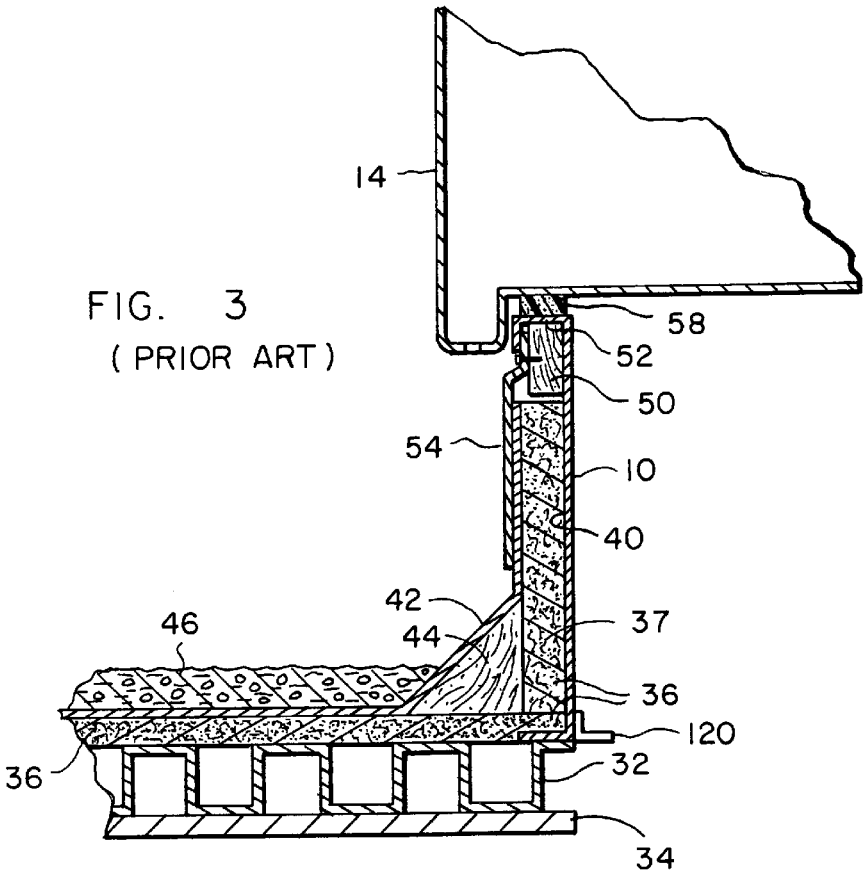
FIG. 3 (PRIOR ART)
FIG. 3 is a partial cutaway of the prior art curb the curb of FIG. 1 along lines 3—3 with the air conditioning shown in place.
Figure 4:
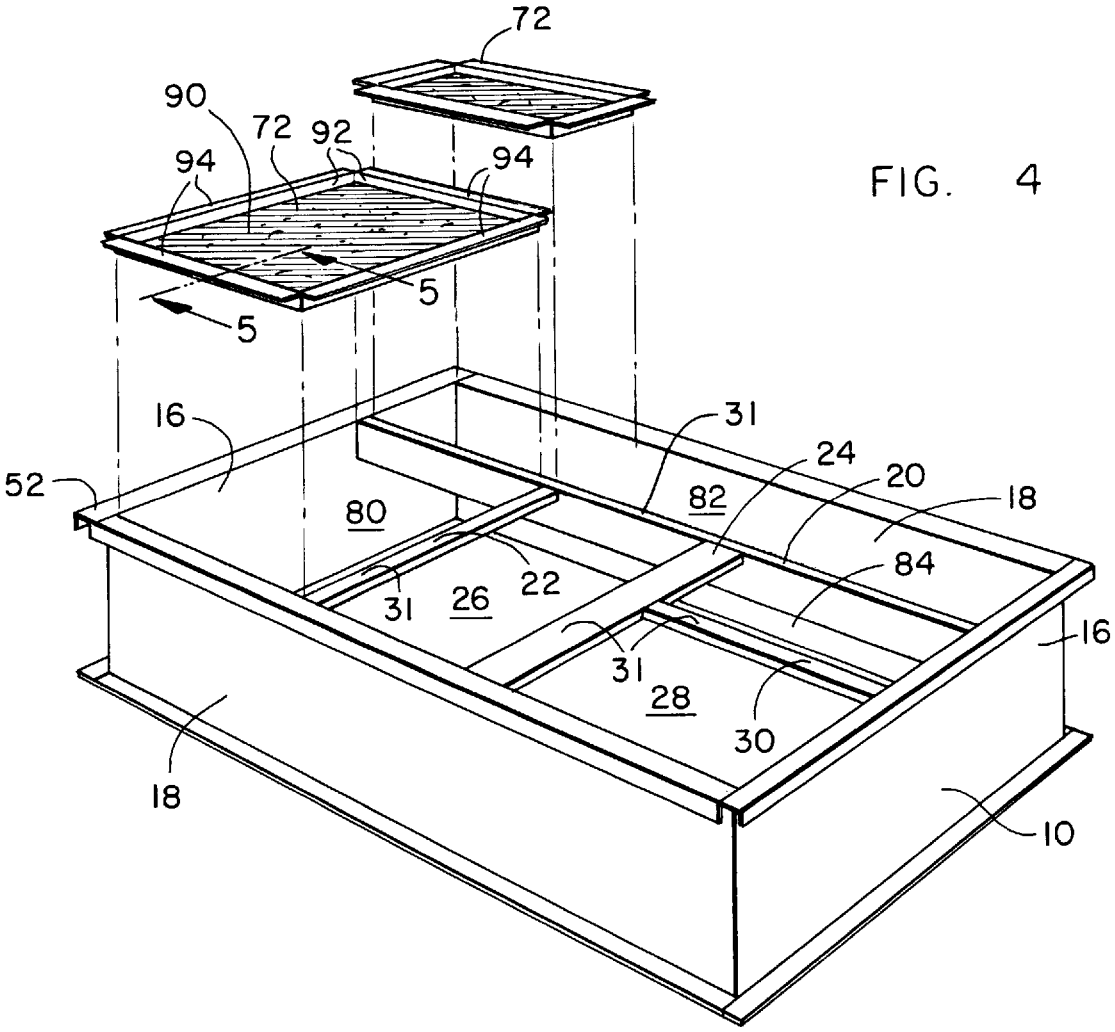
FIG. 4 is a rooftop curb with a first arrangement of the present invention exploded upwardly.

FIGS. 1–3 show applicant's prior roof mounting curb 10 applied to a building 12 and supporting an air conditioning unit 14 (see FIG. 3). The roof mounting curb 10 is a frame 11 including end walls 16 and side walls 18. The frame 11 includes a full length support 20 extending between the end walls 16 and parallel to the sidewalls 18. An end support 22 extends between one sidewall 18 and the full length support 20 and is parallel to the end walls 16. A dividing support 24 is provided between the side wall 18 and the full length support 20 so as to frame a supply air opening 26 and a return air opening 28. The supply air opening 26 is framed by the end support 22, the dividing support 24, the full length support 20 and a side wall 18. The return air aperture 28 is framed by a side wall 18, an end wall 16, the dividing support 24 and either the full length support 20 as shown in FIG. 1 or a short support 30 which, as shown in FIG. 4, is arranged between an end wall 16 and the dividing support 24 in a direction parallel to the sidewalls 18. For any particular air conditioning system, these supports are sized and arranged to frame the supply air aperture 26 or return air aperture 28 dimensions as needed by the particular air conditioning system.

Each end wall 16 and side wall 18 is supported by roof decking 32, the roof decking 32 being in turn supported by roof supports 34. Roof insulation 36 is applied to the building roof 12 and curb insulation 37 is applied to the exterior surfaces 40 of the side walls 18 and the end walls 16. Composition flashing 42 is generally applied over the roof and curb insulation 36, 37, often with a cant strip 44 to provide the smooth transition of the composition flashing 42 as the flashing 42 turns 90°. Composition roofing 46 is applied over the roof insulation 36 but generally not over the cant strip 44 or the curb insulation 37. A nailing strip 50 is attached to the side walls 18 and the end wall 16 within an outwardly flanged upper supporting end 52 of those sidewalls 18 and endwalls 16. The nailing strip 50 is used to provide support for curb flashing 54 which can overlay the curb insulation 37. The air conditioning unit 14 is positioned atop the ends 52 usually with an intermediate gasket sealer 58.

Inasmuch as the roof mounting curb 10 is located over a large aperture 60 (see FIG. 2) located in the roof of the building 12, the noise and heat energy generated by the air conditioning unit 14 is generally free to travel in a downward direction into the building itself where it can disturb the occupants and affect the efficiency of the air conditioning unit by adding to the building's heat load.

Figure 6:
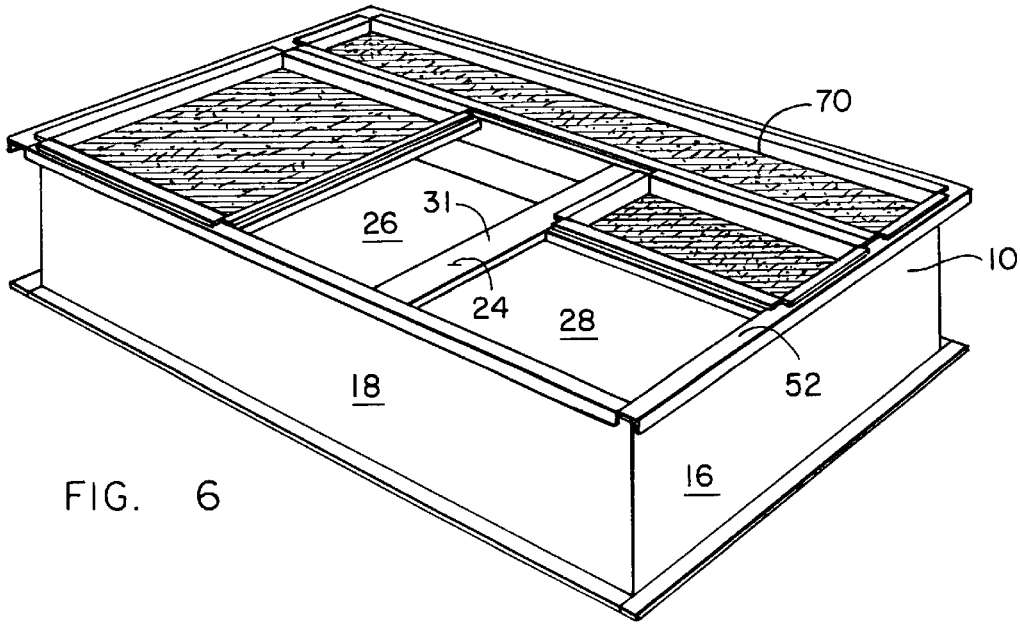
FIG. 6 is a rooftop curb with a second arrangement of the present invention in place.

In the arrangement shown in FIG. 6 the present invention adds a barrier 69 such as a deck 70 to the rooftop curb 10 to provide a sound and temperature barrier between the interior of the building 12 and the air conditioning unit 14. In the preferred arrangement shown in FIG. 4, this barrier 69 is accomplished by a plurality of deck pans 72 shaped as necessary to block all apertures in the curb 10 other than the supply air aperture 26 and the return air aperture 28. In FIG. 4 these apertures include an aperture 80 formed by the end support 22, the full support 20, and end wall 16, and a side wall 18. A further aperture 82 is formed between a side wall 18, the full support 20, and the end walls 16. FIG. 4 shows an additional aperture 84 between the short support 30, full support 20, the dividing support 24, and an end wall 16. Individual deck pans 72 are shaped and positioned to block each of these apertures 80, 82, 84.

Although the single deck 70 of FIG. 6 could be formed and conventionally attached to the curb 10, the various sizes of the return air and supply air apertures 26, 28 are better and more conveniently addressed by the plurality of deck pans 72. Each deck pan 72 includes a broad planar region or pan 90 having a generally rectangular shape. The planar region 90 is surrounded by four generally perpendicular box walls 92 where each box wall 92 terminates in a flange 94 turned outward about 90°. The flanges 94 are sized to overhang the aperture being blocked and are conventionally fastened by screws or other fasteners to the upper surfaces 52, 31 of the roof mounting curb 10 specifically including the upper surfaces 52, 31, the endwalls 16, the sidewalls 18 and the various full, dividing, short and end supports 20, 24, 30 and 22 respectively.

Figure 5:
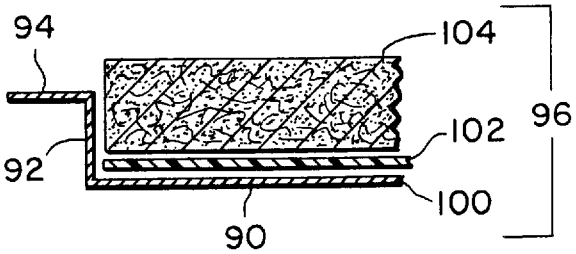
FIG. 5 shows a cutaway of the deck pan of FIG. 4 along lines 5—5.

Each deck 70 or deck pan 72 is formed in three layers 96 as is best shown in FIG. 5. In the case of the deck pan 72, the flange 94, the box wall 92, and the generally planar region 90 are preferably formed of sheet metal to provide a first structural support layer 100. In the case of the deck 70, no box wall 92 is required and the generally planar region 90 is substantially coextensive with the apertures 80, 82 and 84 to be covered, but is also formed of sheet metal to provide the first structural support layer 100. For each case, a second sound barrier layer 102 is affixed to the planar region 90 of the structural support layer 100 by an adhesive such as industrial water-based synthetic latex and a third heat energy barrier layer 104 is affixed to the sound barrier layer 102 by an adhesive such as industrial water-based synthetic latex.

The sound barrier 102 is a dual density or multiple density material such as a polycore constrained layer steel damping material. The heat energy barrier layer 104 is a fiberglass material such as 1" thick, 3 pound per cubic foot density with plastic polymer coating one side which provides a heat energy barrier. Alternative sound insulation materials for the sound barrier layer 102 include similar polycore materials having varying thickness'. Alternative materials for the heat energy barrier layer 104 include half inch thick material sold by the Manville Corp. under the Tufskin™ trademark.

Figure 7A:
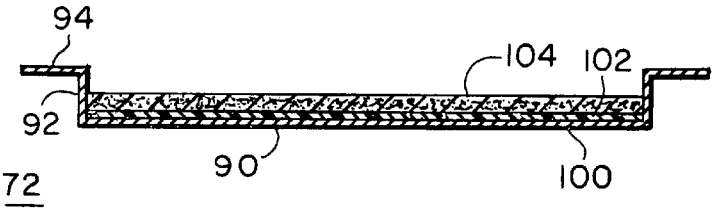
FIG. 7*a* shows the preferred embodiment as applied to FIGS. 4 and 6.

FIG. 5 shows the preferred embodiment of the three layered barrier 96 where the sound barrier layer 102 is sandwiched between the heat energy barrier layer 104 and the structural support layer 100. This preferred embodiment is also shown in FIG. 7*a*.

Figure 7B:
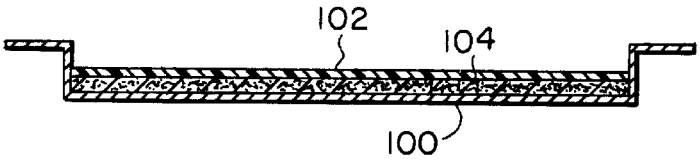
FIG. 7*b* shows a second embodiment.
Figure 7C:
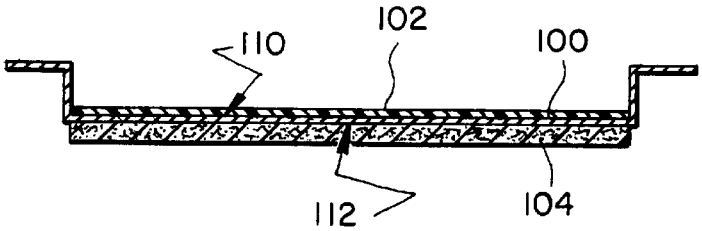
FIG. 7*c* shows a third embodiment.
Figure 7D:
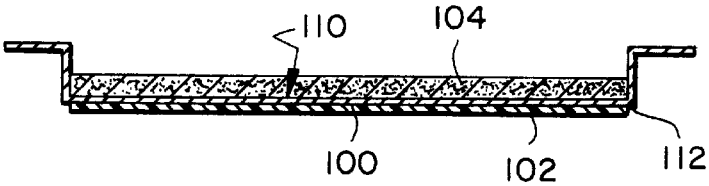
FIG. 7*d* shows a fourth embodiment.
Figure 7E:
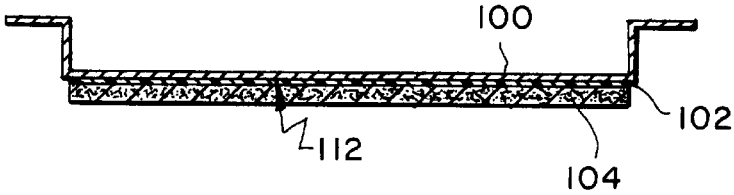
FIG. 7*e* shows a fifth embodiment.
Figure 7F:
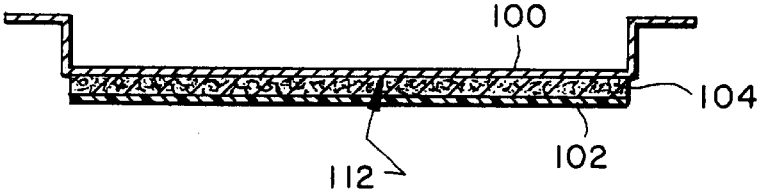
FIG. 7*f* shows a sixth embodiment.

FIGS. 7*b* through 7*f* show alternative arrangements of the three layered barrier 96 of the present invention. In FIG. 7*b*, the heat energy barrier layer 104 is sandwiched between the sound barrier layer 102 and the structural support layer 100. In FIG. 7*c*, the sound barrier layer 102 is glued to a top surface 110 of the structural support layer 100 while the temperature barrier layer 104 is affixed to a bottom surface 112 of the structural support layer 100. In the alternative embodiment of FIG. 7*d*, the sound barrier layer 102 is affixed to the bottom surface 112 of the structural support layer 100, while the heat energy barrier layer 104 is affixed to the upper surface 110 of the structural support layer 100. In FIG. 7*e*, the sound barrier layer 102 is sandwiched between the structural support layer 100 and the heat energy barrier layer 104 but affixed to the lower surface 112 of the structural support 100. Finally, in FIG. 7*f*, the heat energy barrier layer 104 is sandwiched between the sound barrier 102 and the structural support layer 100 on the lower surface 112 of the structural support layer 100.

Figure 8:
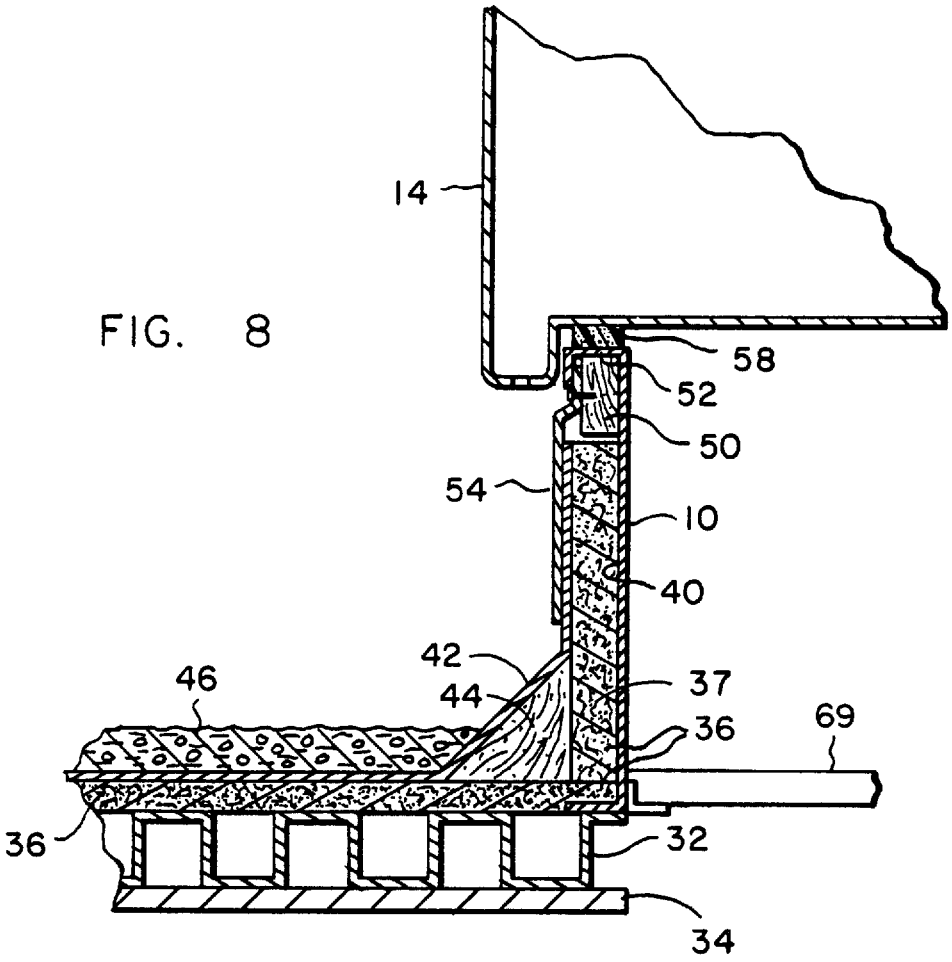
FIG. 8 shows the present invention in an alternative location.

The three layers 96 can also be applied to the side walls 18 and the end walls 16 but would not have the full benefits of the deck pan 72 or the deck 70 since sound and energy could still enter the aperture 60. The deck 70 or the deck pans 72 could also be located on a bottom support 120 of the curb 10, as shown in FIG. 8.

The invention can be provided with new rooftop curbs or can be easily retrofit to existing curbs whenever the air conditioning unit is removed from the curb 10. For retrofits, appropriately sized deck pan 72 or a deck 70 are applied to the curb and the air conditioning unit replaced.

What is claimed for Letters Patent of the United States is exemplified in the following claims:

1. A curb for a rooftop air conditioning unit comprising:

a frame having side walls and end walls arranged in a generally rectangular shape; and a generally planar portion overlaying a portion of the frame, the planar portion including a first layer providing structural support, a second layer formed of a first material and providing a sound barrier, and a third layer formed of a second material different than the first material and providing a heat energy barrier.

2. The curb of claim 1 where the first layer is sheet metal, the second layer is polycore and the third layer is fiberglass.

3. The curb of claim 2 including a supply air aperture and a return air aperture in the planar portion.

4. The curb of claim 3 wherein the planar portion is formed as a continuous deck.

5. A curb for a rooftop air conditioning unit comprising:

a frame having side walls and end walls arranged in a generally rectangular shape; and a generally planar portion overlaying a portion of the frame, the planar portion including a first layer providing structural support, a second layer providing a sound barrier, and a third layer provides a heat energy barrier where the first layer is sheet metal, the second layer is polycore and the third layer is fiberglass;

a supply air aperture and a return air aperture in the planar portion;

where the frame includes internal supports defining the supply and return air aperture and wherein the planar portion comprises a plurality of deck pans supported by the frame.

6. The curb of claim 5 wherein each deck pan includes a planar region defining the planar portion, a box wall around the planar region and a flange terminating the box wall and operably connected to the frame.

7. A deck pan for a rooftop curb comprising:

a generally planar pan having a structural support layer, a sound barrier layer formed of a first material and affixed to the structural support layer and a heat energy barrier layer formed of a second material other than the first material and affixed to the sound barrier layer;

a box wall attached and surrounding the pan; and a flange attached to and about the box wall.

8. The deck pan of claim 7 wherein the sound barrier layer comprises at least a dual density polycore material, wherein the heat energy barrier layer comprises fiberglass, and where the structural support layer comprises sheet metal.

9. A rooftop curb comprising:

a deck;

a frame supporting the deck, the frame including side walls and end walls;

a supply air aperture in the deck;

a return air aperture in the deck; and wherein the deck has three layers: a structural support layer, a sound barrier layer and a heat energy barrier layer.

10. The curb of claim 9 wherein the structural support layer comprises sheet metal, the sound barrier layer comprises polycore material; and the heat energy barrier layer comprises fiberglass.

11. The curb of claim 10 where the side wall and the end walls also have a structural support layer, a sound barrier layer and a heat energy barrier layer.

12. The curb of claim 10 wherein the sound barrier layer is sandwiched between the structural support layer and the heat energy barrier layer.

13. The curb of claim 12 wherein the sound barrier layer is located above the structural support layer.

14. The curb of claim 12 wherein the sound barrier layer is located below the structural support layer.

15. The curb of claim 10 wherein the heat energy barrier layer is sandwiched between the structural support layer and the sound barrier layer.

16. The curb of claim 15 wherein the heat energy barrier layer is located above the structural support layer.

17. The curb of claim 15 wherein the heat energy barrier layer is located below the structural support layer.

18. The curb of claim 10 wherein the structural support layer is sandwiched between the sound barrier layer and the heat energy barrier layer.

19. The curb of claim 18 wherein the sound barrier layer is above the structural support layer.

20. The curb of claim 18 wherein the heat energy barrier layer is located above the structural support layer.

21. The rooftop curb comprising:

a deck;

a frame supporting the deck, the frame including side walls and end walls;

a supply air aperture in the deck; and a return air aperture in the deck;

wherein the deck has three layers: a structural support layer, a sound barrier layer and a heat energy barrier layer;

wherein the structural support layer comprises sheet metal, the sound barrier layer comprises polycore material; and the heat energy barrier layer comprises fiberglass; and wherein the deck is a unitary surface positioned atop upper surface of the frame.

22. The curb of claim 10 wherein the deck is located proximate a bottom support of the frame.

23. The rooftop curb comprising:

a deck;

a frame supporting the deck, the frame including side walls and end walls;

a supply air aperture in the deck;

a return air aperture in the deck;

wherein the deck has three layers: a structural support layer, a sound barrier layer and a heat energy barrier layer;

wherein the structural support layer comprises sheet metal, the sound barrier layer comprises polycore material; and the heat energy barrier layer comprises polycore material; and the heat energy barrier layer comprises fiberglass; and wherein the deck is formed as a plurality of deck pans, each having a rectangular shape and flanges adapted to engage the frame.

24. A method of providing a sound and heat energy barrier in a rooftop curb having a frame, a return air aperture, and a supply air aperture, the method comprising the steps of:

forming a structural support layer sized to engage an upper surface of the frame without blocking the supply air and return air apertures;

applying a sound barrier layer to the structural support layer;

applying a heat energy barrier to the sound barrier layer;

placing the structural support layer on the frame; and affixing the structural support layer to the frame.

25. The method of claim 24 including the step of forming the structural support layer as a substantially unitary piece.

26. The method of claim 24 including the step of forming the structural support layer as a plurality of deck pans.

* * * * *